US007503412B2

(12) United States Patent
François

(10) Patent No.: US 7,503,412 B2
(45) Date of Patent: Mar. 17, 2009

(54) CONCRETE MACHINE

(75) Inventor: Casters François, Opglabbeek (BE)

(73) Assignee: CMI Belgium, Naamloze Vennootschap, Opglabbeek (BE)

( * ) Notice: Subject to any disclaimer, the term of this patent is extended or adjusted under 35 U.S.C. 154(b) by 589 days.

(21) Appl. No.: 10/994,276

(22) Filed: Nov. 23, 2004

(65) Prior Publication Data

US 2005/0194195 A1 Sep. 8, 2005

(30) Foreign Application Priority Data

Nov. 24, 2003 (BE) ..... 2003/0629

(51) Int. Cl.
*B62D 55/00* (2006.01)
*E01C 19/12* (2006.01)

(52) U.S. Cl. ..... 180/9.52; 180/9.5; 404/105

(58) Field of Classification Search ..... 180/9.5, 180/9.52, 408; 404/105
See application file for complete search history.

(56) References Cited

U.S. PATENT DOCUMENTS

| | | | | | |
|---|---|---|---|---|---|
| 3,540,360 | A | * | 11/1970 | Swisher, Jr. et al. | 404/84.2 |
| 3,970,405 | A | * | 7/1976 | Swisher et al. | 404/105 |
| 4,029,165 | A | * | 6/1977 | Miller et al. | 180/6.48 |
| 4,360,293 | A | | 11/1982 | Wade | |
| 4,789,266 | A | * | 12/1988 | Clarke et al. | 404/96 |
| 5,590,977 | A | * | 1/1997 | Guntert et al. | 404/101 |
| 6,481,924 | B1 | | 11/2002 | Smolders et al. | |

* cited by examiner

*Primary Examiner*—Paul N Dickson
*Assistant Examiner*—Marc A Scharich
(74) *Attorney, Agent, or Firm*—Bacon & Thomas, PLLC

(57) ABSTRACT

Concrete machine which is mainly composed of a chassis and of caterpillar drives, upon which the chassis is provided via arms, which arms can be adjusted in height, characterized in that the concrete machine is provided with a system for adjusting the chassis in height in relation to the arms.

10 Claims, 5 Drawing Sheets

CONCRETE MACHINE

BACKGROUND OF THE INVENTION

1. Field of the Invention

The present invention concerns a concrete machine, more particularly a concrete machine which is provided with a height adjustment and which preferably can be equipped with different tools for producing ditches, sidewalks, concrete paths or the like.

2. Discussion of the Related Art

Such a concrete machine which is mainly composed of a caterpillar drive provided with several supporting arms supporting a chassis is already known.

In this known concrete machine, the caterpillar drive is provided with means, for example a hydraulic piston, which makes it possible to move the above-mentioned supporting arms vertically or almost vertically.

The chassis of the known concrete machine is further provided with means which make it possible to fix an aforesaid tool on a side of the chassis or under the chassis.

A disadvantage of this known concrete machine is that, in order to adjust the tool in height, the entire chassis always has to be adjusted together with the above-mentioned arms.

This is disadvantageous in that the center of gravity of the concrete machine will be situated relatively high, when a tool is used which is relatively high itself or when there is a large difference in level between the working area and the driving area of the caterpillar drives, which results in a reduced stability of the concrete machine, so that, when constructing a road or the like, the finish of the road surface will be poor.

Another disadvantage is that the adjustment in height of the chassis is limited and in that the arms which support the chassis cannot be lowered under the level of the caterpillar drives, as a result of which , in order to work a surface situated under the level of the caterpillar drive, for example when working in ditches, the tool concerned must have a relatively large height, as it must bridge the distance between the chassis and the working area.

This is disadvantageous in that different tools must be provided having the same function but with a different height, so that not only a lot of tools will have to be acquired, but as a result of which, in many cases, the number of tools also forms a major disadvantage for the mobility of the concrete machine between for example different construction sites.

SUMMARY OF THE INVENTION

The present invention aims to remedy one or several of the above-mentioned and other disadvantages.

To this end, the invention concerns a concrete machine which is mainly composed of a chassis and of caterpillar drives, upon which the chassis is provided by means of arms, which arms can be adjusted in height, whereby the concrete machine is provided with means for moving the chassis in height in relation to the arms.

Preferably, these above-mentioned means for moving the chassis in height mainly consist of at least one carriage which is provided such that it can shift on at least one guide which is part of the chassis, and upon which one or several of the above-mentioned arms are fixed; and of a drive for moving the carriage.

An advantage of the concrete machine according to the invention is that the chassis can be moved in height in relation to the arms which can be moved in height themselves in relation to the caterpillar drive, such that the concrete machine has more possibilities for adjusting the center of gravity than in the case of the known concrete machines, so that the lowest center of gravity can at all times be set in order to obtain more stability. An advantage of this double height adjustment is that the chassis can be lowered in between the caterpillar drive, as a result of which a tool can extend relatively far under the caterpillar drive.

BRIEF DESCRIPTION OF THE DRAWINGS

In order to better explain the characteristics of a concrete machine according to the invention, the following preferred embodiment is described as an example only without being limitative in any way, with reference to the accompanying drawings, in which.

DESCRIPTION OF A PREFERRED EMBODIMENT

Figure 1:
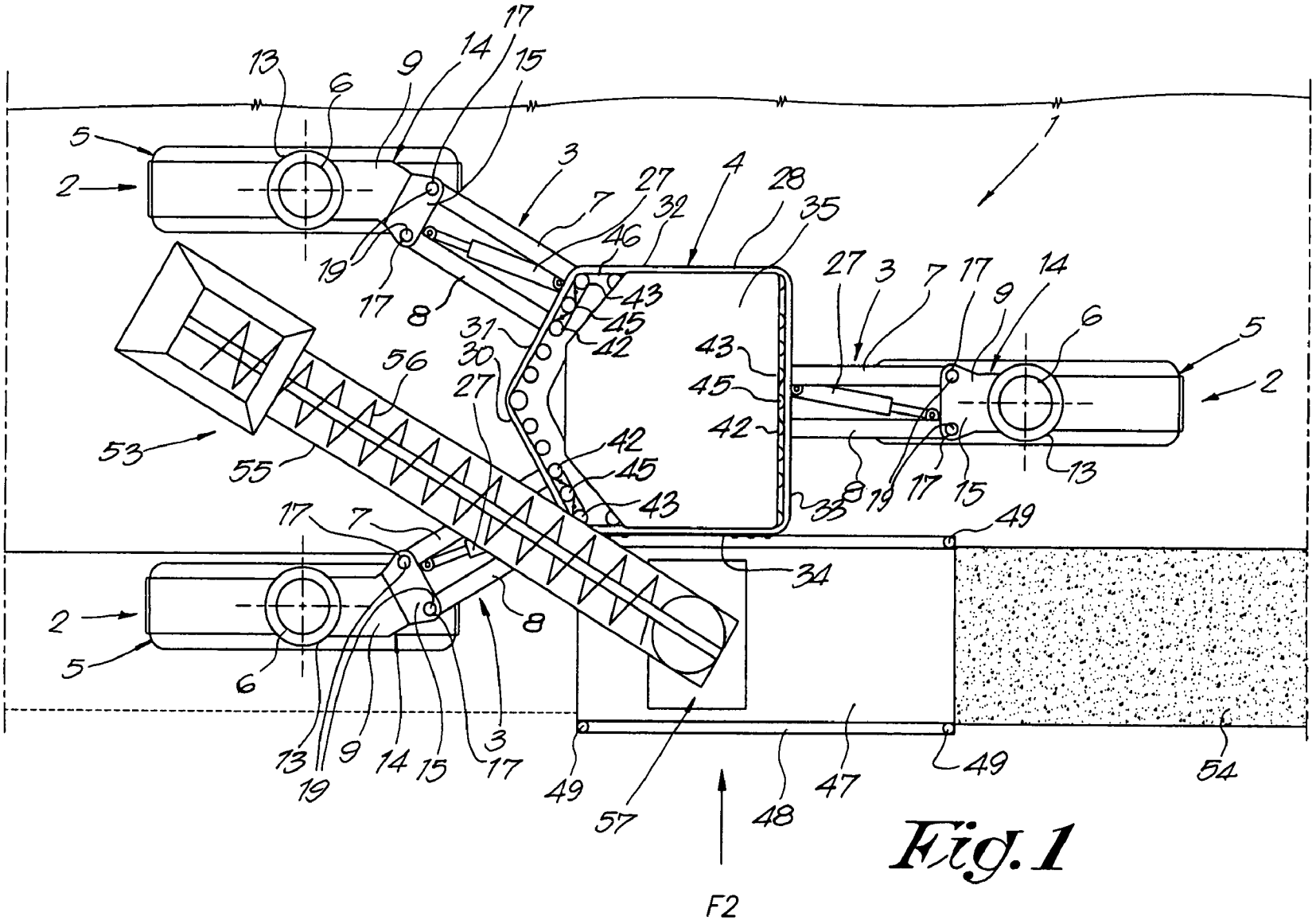
FIG. 1 schematically represents a concrete machine according to the invention.
Figure 2:
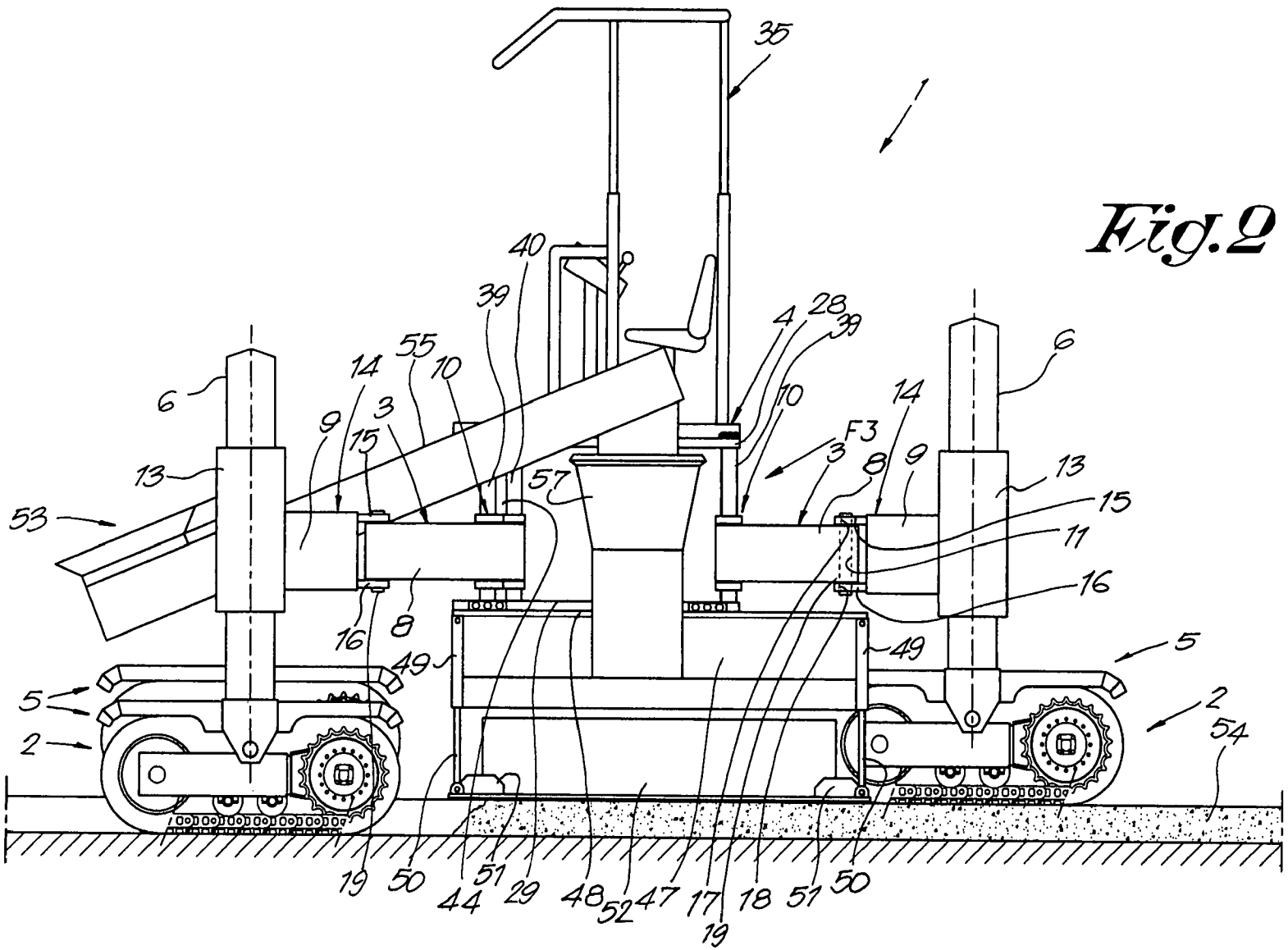
FIG. 2 represents a view according to arrow F2 in FIG. 1.

FIGS. 1 and 2 schematically represent a concrete machine 1 according to the invention which is mainly composed of one or several caterpillar drives 2, upon which a moving arm 3 is each time provided; and of a chassis 4, whereby means are provided between the chassis 4 and the arms 3 for moving the chassis 4 in height in relation to the above-mentioned arms 3.

The caterpillar drives 2 each contain, as is known, a wheel house 5, upon which a bar 6 is centrally mounted which extends vertically or almost vertically upward.

Each of the above-mentioned arms 3 mainly consists of two parallel beams 7-8 which are equally long and which are fixed to a mainly tubular part 9 on the one hand, and to a carriage 10 on the other hand, whereby the beams 7-8 are each provided with two passages 11-12, one on each far end, which extend in the vertical height of the beams 7-8.

The tubular part 9 consists of a hollow, cylindrical body and has a protrusion 14 on its outer side which is provided with two parallel ears 15-16 on its far end, in which are each time provided two holes 17-18.

Through each of the holes 17-18 and through the passages 11 in the beams 7-8 concerned, is each time provided a shaft 19, such that the beams 7-8 are fixed in a rotating manner between the ears 15-16.

Each of the above-mentioned tubular parts 9 is, as is known, provided on the bar 6 of the caterpillar drives 2 concerned in a rotating manner, whereby the bar 6 and the tubular part 9 are equipped with known means 13 for moving the tubular part 9 in height in relation to the bar 6, for example in the shape of a cylinder, which means are not represented in the figures, however.

Figure 3:
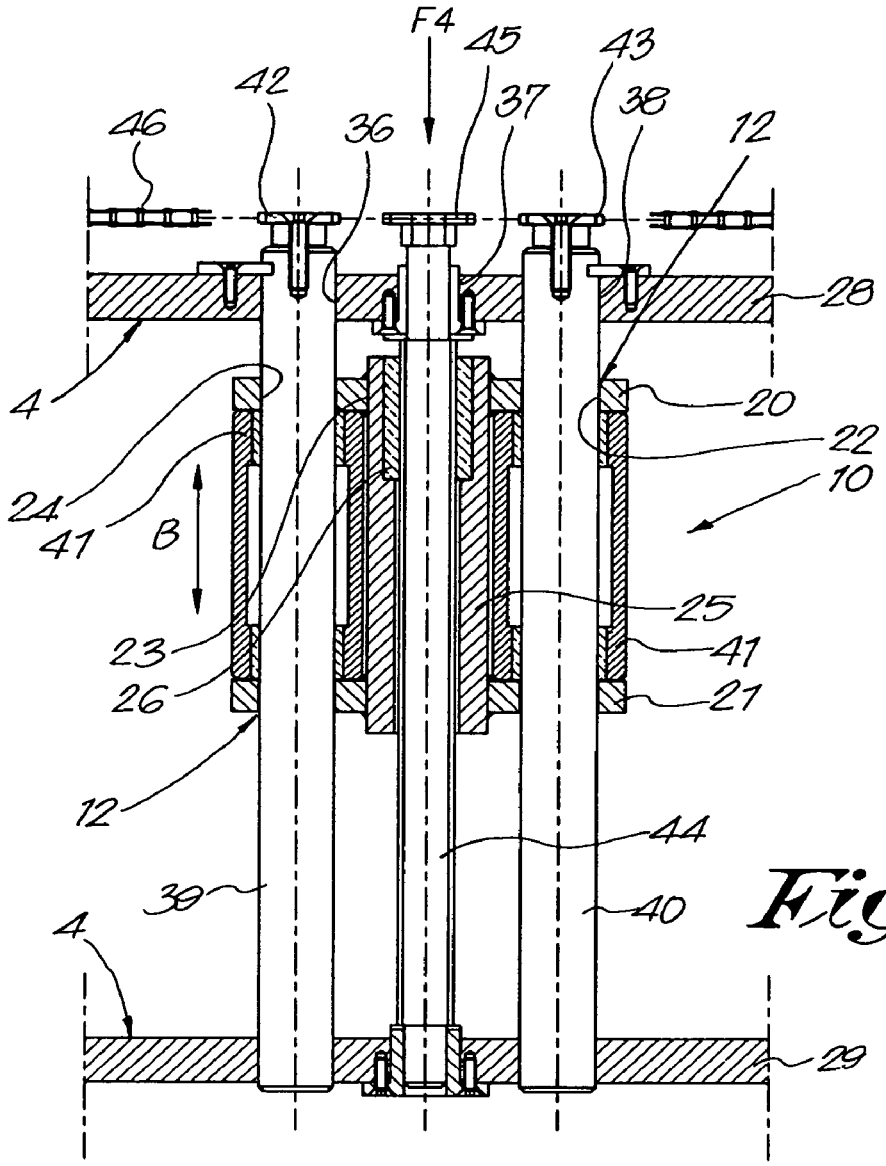
FIG. 3 represents a section to a larger scale of a part which is indicated by arrow F3 in FIG. 2.

As represented in FIG. 3, each carriage 10 consists, in this case, of a pair of parallel plates 20-21, through which are each time provided three holes 22-23-24 which, in this case, are situated in a single line.

Through the central holes 23 in each pair of plates 20-21, is each time fixed a bush with a co-axially provided nut 26.

On either side of the above-mentioned bush 25, the far ends of each of the beams 7-8 of the arm 3 concerned are provided between the pair of plates 20-21 concerned in a rotating manner, whereby the holes 22 and 24, in the plates 20-21, are situated in the prolongation of the passage 12 concerned in the above-mentioned beams 7-8.

According to the above-described embodiment, each pair of ears 15-16 forms a parallelogram, together with the beams 7-8 concerned and the carriage 10 concerned, in which, as is known, is provided a cylinder 27 in the diagonal direction, which cylinder 27 is preferably a hydraulic cylinder.

The chassis 4 mainly consists of two parallel frames 28-29, which are situated at a mutual distance which is substantially larger than the height of the beams 7-8 of the arms 3.

Both frames 28-29 are, in this case, made pentagonal with five sides, 30 to 34 respectively.

On the top frame 28 of the chassis 4 is provided a cockpit 35, whereas, in this case, in the sides 30, 31, 33 of both frames 28-29 are each time provided three holes 36-37-38, whereby the mutual distances between these holes 36-37-38 are equal to the mutual distances between the holes 22-23-24 in the plates 20-21 of the carriage 10.

The chassis 4 is further provided with guides 39-40 in the shape of bars, which are provided through each of the holes 36 and 38 in the frames 28-29, whereby the carriage 10 is mounted on these guides 39-40 by means of slide bearings 41 which are fixed in the passages 12 of the beams 7-8, such that said carriage can shift.

Figure 4:
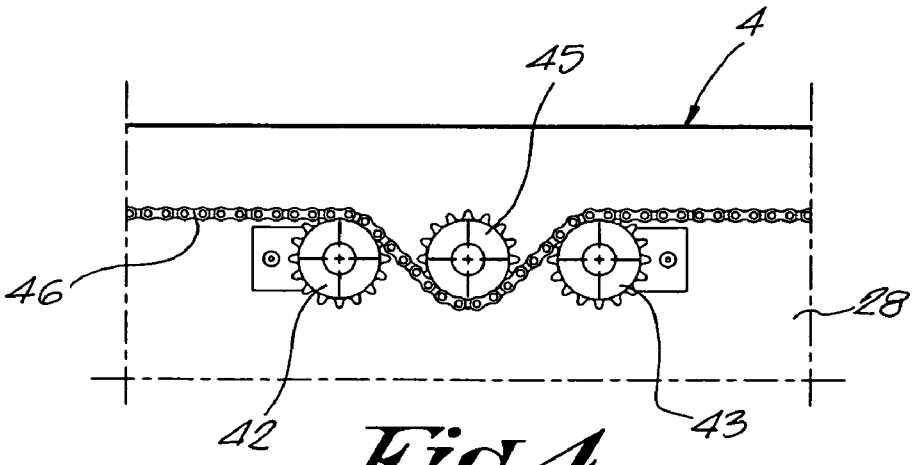
FIG. 4 represents a view according to arrow F4 in FIG. 3.

As represented in FIGS. 3 and 4, a freely rotating gear wheel 42-43 is provided on a free end of and co-axial with each of the above-mentioned guides 39-40.

Through each of the central holes 37 in the frames 28-29 and through the bush 25 concerned is provided a rotating threaded rod 44 which is equipped with a gear wheel 45, which gear wheel 45 is fixed in the prolongation of said threaded rod 44.

An endless chain 46 which is equipped with a drive, not represented in the figures, is guided over the gear wheels 42, 43, and 45 in a zigzag pattern.

The chain drive will preferably be common to all threaded rods 44, whereby, in that case, the sole chain 46 is guided round the cockpit 35 over the gear wheels 42, 43, and 45 of all guides and all the above-mentioned threaded rods 44.

For the use of the above-described concrete machine 1, a tool holder 47 is fixed next to and/or under the lower frame 29 of the chassis 4, which tool holder mainly consists of a frame 48 upon which are fixed different cylinders 49.

The bars 50 of the above-mentioned cylinders 49 carry supports 51 onto which can be fixed a tool 52, such as for example a gauge or a vibrating device.

Figure 5:
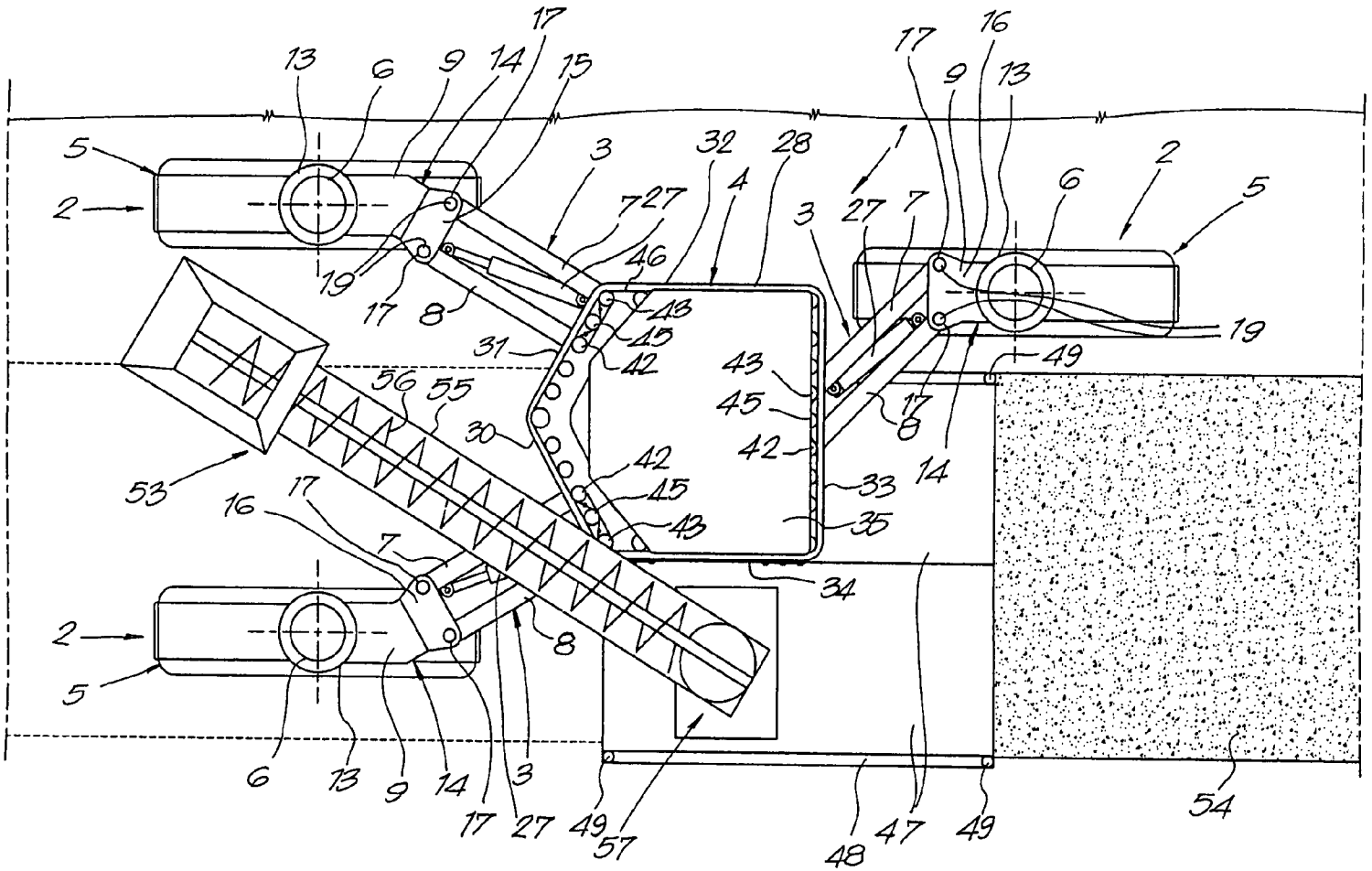
FIG. 5 schematically represents the concrete machine from FIG. 1, but in another arrangement.

In the case of FIGS. 1, 2 and 5, a tool 52 is represented which is equipped with a device 53 for supplying concrete 54 or the like, which device 53 in this case consists of a supply 55 in which is provided an Archimedean screw 56, which supply 55 discharges into a conical funnel 57 which is provided in or in front of the tool 52.

The concrete machine 1 is provided in the known manner with a motor, not represented in the figures, for exciting a hydraulic circuit with a pump and control means for the drive of, respectively, the hydraulic motors of the caterpillar drives 2; the cylinders 27 of the arms 3; the chain drive of the means for moving the chassis 4 in relation to the arms 3; the cylinders 49 of the tool holder 47; and the drive of the tools 52.

The working of the concrete machine 1 is simple and as follows.

FIG. 2 represents the concrete machine 1 whereby the arms 3 are positioned more or less centrally in relation to the bars 6 of the caterpillar drives 2.

In this arrangement, the carriages 10 are situated almost entirely at the bottom of the guides 39-40 of the chassis 4, such that the chassis is situated in a relatively high position in relation to the roadway of the caterpillar drives 2, and as a result of which the bars 50 of the cylinders 49 on the above-mentioned tool holder 47 extend relatively far out of the above-mentioned cylinders 49.

In the above-described arrangement, the center of gravity of the concrete machine 1 is situated relatively high above the roadway of the caterpillar drives 2, as a result of which the stability of the concrete machine 1 is rather low.

Figure 6:
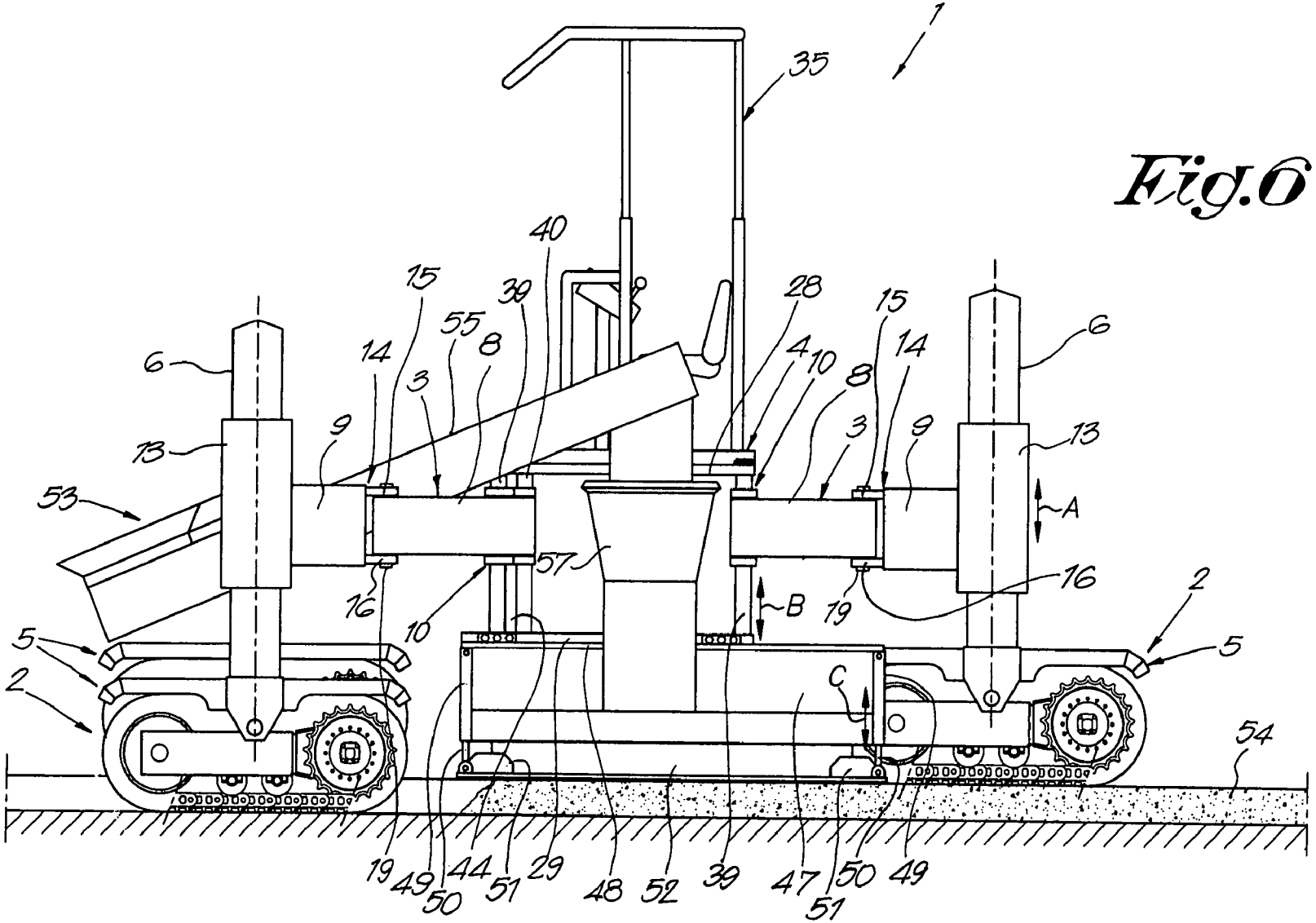
FIG. 6 schematically represents the concrete machine from FIG. 2, but in another arrangement.

FIG. 6, however, represents the same concrete machine 1 with an identical position of the arms 3 in relation to the caterpillar drives 2, but whereby the carriages 10 are situated practically entirely on top of the guides 39-40, such that the chassis 4 is situated in a relatively low position, as a result of which a better stability is obtained in relation to the arrangement represented in FIG. 2.

The above-mentioned bars 50 are now situated relatively deep in the cylinders 49, in order to compensate for the difference in height between the working surface and the level of the chassis 4.

The position of the chassis 4 is adjusted by driving the chain 46 which, in her movement, makes the gear wheels 45 of the threaded rods 44 rotate, as a result of which, thanks to the co-operation between the nuts 26 and the threaded rods 44 concerned, the carriage 10 concerned is moved in relation to the guides 39-40.

By connecting all threaded rods 44 to one and the same chain 46, the same movement of the chassis 4 in relation to each of the arms 3 is always obtained, such that the chassis 4 always moves horizontally.

A third height adjustment of the tool can be obtained by controlling the cylinders 49 which are fixed on the tool holder 47.

It should be noted that adjusting the tool 52 in height in relation to the chassis 4 must not necessarily be done with cylinders 49, for also threaded rods and guides can be used to this end which are driven by a chain, similar to the above-described height adjustment for adjusting the chassis 4 in relation to the arms 3.

These three above-mentioned height adjustments make it possible to always place the chassis 4 at a minimal height in relation to the basic plane, such that the center of gravity of the concrete machine 1 can remain relatively low and the stability of the concrete machine 1 is relatively high, such that a good finish of the concrete product to be processed can at all times be obtained.

It should be noted that several series of holes 36-37-38 can be provided in the frames 28-29 of the chassis 4, such that the guides 39-40 and threaded rods 44 can be fixed in different positions in the chassis 4, such that also the arms 3 can be coupled to the chassis 4 in different positions, which makes it possible to always optimize the position of the caterpillar drives 2 as a function of the work to be carried out.

An additional advantage of these different series of holes 36-37-38 is that it also possible to provide one or several extra caterpillar drives 2. Thus, it is possible for example to provide four caterpillar drives 2, as opposed to the embodiments represented in the figures, where only three caterpillar drives 2 are represented.

Providing a fourth caterpillar drive 2 offers the possibility, among others, to fix wide tools under the concrete machine 1, for example for concreting a lane that is 2.5 m wide.

As the concrete machine 1 is further preferably made symmetrical, it is possible to simultaneously carry out one and the same operation on both sides of the concrete machine 1, by fixing two similar tools 52 on both sides of the chassis 4.

Further, it should be noted that the chain must not necessarily drive all supporting bars 44, for this can also be done by several chains 46, which all drive one or several threaded rods 44, and which are in turn driven by one or several chain drives, not represented in the figures.

Of course, it is also possible to provide other means between the arms 3 and the chassis 4 to move the chassis 4 up and down, such as for example hydraulic cylinders.

Finally, FIG. 6 represents the different height adjustments that are possible in a concrete machine 1 according to the invention, indicated by the double arrows A, B and C, whereby the height adjustment indicated by arrow A amounts to 60 cm, for example, whereas the maximum range of the height adjustments indicated by the arrows B and C amounts to 40 cm, for example, such that the total height adjustment for the concrete machine 1 in this case amounts to 140 cm.

The present invention is by no means limited to the embodiment given as an example; on the contrary, such a concrete machine according to the invention can be made according to different variants while still remaining within the scope of the invention.

The invention claimed is:

1. A concrete machine comprising a chassis adapted for receiving a tool and drive mechanisms having respective wheel housings, said chassis connected to the drive mechanisms having respective wheel housings by means of arms, said arms being adjustable in height, and a chassis height adjusting system arranged to adjust the chassis and the associated tool in height in relation to the arms;

wherein the height adjusting system includes at least two carriages each movably arranged to shift on at least two guides which are part of the chassis, such that rotation of the chassis and the associated tool with respect to the arms and drive mechanisms having respective wheel housings is prevented.

2. The concrete machine according to claim 1, wherein one or several of the arms are fixed to the at least two carriages; and further comprising a drive for moving a respective one of the at least two carriages.

3. The concrete machine according to claim 2, wherein said drive comprises at least one chain drive including at least one chain which is guided around a gear wheel of at least one threaded rod, which at least one threaded rod extends through a nut which is part of the respective one of the at least two carriages.

4. The concrete machine according to claim 3, wherein at least one of the at least two guides is additionally provided with at least one freely rotating gear wheel, and wherein the at least one chain is guided in a zigzag pattern over the at least one freely rotating gear wheel of the at least one of the at least two guides and over the gear wheel of the at least one threaded rod.

5. The concrete machine according to claim 2, wherein each arm is respectively connected to a respective one of the at least two carriages.

6. The concrete machine according to claim 3, wherein the at least one chain drive comprises a common chain which is guided around the respective gear wheels of a plurality of the at least one threaded rod.

7. The concrete machine according to claim 2, wherein a plurality of the at least two guides each extend through different respective holes which are provided in the chassis, such that the plurality of the at least two guides can be fixed in different positions on the chassis.

8. The concrete machine according to claim 2, wherein said drive comprises at least one chain drive including at least one chain which is guided around a gear wheel of at least one threaded rod extending through a nut which is part of at least one of the at least two carriages, and wherein a plurality of the at least one threaded rod is provided through a respective plurality of holes in the chassis, and wherein for every threaded rod, additional holes are provided in the chassis corresponding to a plurality of the at least two guides.

9. The concrete machine according to claim 1, wherein the arms comprise two parallel beams having an equal length, which arms are each hinge-mounted with one end connected to a respective one of the at least two carriages and the other end to a respective drive mechanism having a respective wheel housing.

10. The concrete machine according to claim 9, including an actuator cylinder extending between the respective one of the at least two carriages and the respective drive mechanism having a respective wheel housing.

* * * * *